US006157119A

United States Patent [19]

Hung et al.

[11] Patent Number: 6,157,119

[45] Date of Patent: Dec. 5, 2000

[54] SHADOW MASK WITH IMPROVED COLOR PURITY ADJUSTMENT MARGIN

[75] Inventors: Hao-Cheng Hung, Hsinchu County; Wen-Chi Chen, Taipei; Yu-Hsin Hu, Hsinchu; Chun-Hung Lu, Changhwa, all of Taiwan

[73] Assignee: Chunghwa Picture Tubes, Ltd., Yangmei/Taoyuan, Taiwan

[21] Appl. No.: 09/154,658

[22] Filed: Sep. 18, 1998

[51] Int. Cl.[7] ..... H01J 29/80

[52] U.S. Cl. ..... 313/402; 313/403; 313/408

[58] Field of Search ..... 313/402, 403, 313/408

[56] References Cited

U.S. PATENT DOCUMENTS

| | | | |
|---|---|---|---|
| 3,735,190 | 5/1973 | Say | 315/13 |
| 5,072,150 | 12/1991 | Lee | 313/405 |
| 5,126,624 | 6/1992 | Ji | 313/402 |
| 5,210,459 | 5/1993 | Lee | 313/406 |
| 5,243,253 | 9/1993 | Marks et al. | 313/402 |
| 5,534,746 | 7/1996 | Marks et al. | 313/408 |
| 5,917,273 | 6/1999 | Watanabe et al. | 313/402 |

*Primary Examiner*—Nimeshkumar D. Patel
*Assistant Examiner*—Karabi Guharay
*Attorney, Agent, or Firm*—Emrich & Dithmar

[57] ABSTRACT

An apertured shadow mask in a color cathode ray tube (CRT) serves as a color selection electrode in permitting each of the three electron beams to be incident only upon its associated color-producing phosphor elements on the CRT's display screen. The apertures are arranged in vertical columns and horizontal rows in the shadow mask with aperture spacing defined by a vertical pitch ($P_v$) i.e., the vertical spacing between adjacent apertures within the same vertical column where the apertures in one row are in different columns than the apertures in adjacent rows, and a horizontal pitch ($P_h$), i.e., the horizontal spacing between adjacent apertures in the same horizontal row. To increase the color purity adjustment margin particularly in the corners of the display screen while still maintaining sufficient vertical spacing between adjacent phosphor dot color trios for a high degree of video image resolution, $P_v$ is defined in terms of a monotonic decreasing function in the horizontal direction and a monotonic increasing function in the vertical direction as follows:

$$P_v(X,Y)=P_{vo}\times F(X)\times G(Y)$$

where $P_{vo}$=vertical pitch of apertures at Y=0 and X=0;
$F(X)=1+a_1X^2+a_2X^4+a_3X^6+\ldots$;
$G(Y)=1+b_1Y^2+b_2Y^4+b_3Y^6+\ldots$;
$a_1, a_2, a_3, \ldots$ are constants and $a_1<0$; and
$b_1, b_2, b_3, \ldots$ are constants and $b_1>0$.

2 Claims, 2 Drawing Sheets

SHADOW MASK WITH IMPROVED COLOR PURITY ADJUSTMENT MARGIN

FIELD OF THE INVENTION

This invention relates generally to color cathode ray tube (CRTs) incorporating a color selection electrode in the form of an apertured shadow mask and is particularly directed to a n electron beam passing aperture array in a shadow mask which affords increased color purity adjustment margin while maintaining a high degree of video image resolution, particularly in the corners of the CRT's display screen.

BACKGROUND OF THE INVENTION

Color CRTs employ an electron gun arrangement that generates three electron beams, one for each of the primary colors of red, green and blue. A common approach is to arrange the three electron beams in an inline array and to simultaneously scan the three electron beams in a raster-like manner from the top to the bottom of the CRT's display screen. The shadow mask includes hundreds of thousands of small electron beam passing apertures and serves as a color selection electrode permitting each electron beam to be incident only upon its associated color producing phosphor elements on the inner surface of the CRT's display screen. The shadow mask and display screen are typically provided with a spherical curvature in an axially symmetric fashion and are arranged in closely spaced relation in the CRT, The large number of electron beam passing apertures in the shadow mask are arranged in a closely spaced manner. The spacing between adjacent apertures is defined in terms of a vertical pitch, i.e., the vertical center-to-center spacing between adjacent apertures in the same vertical column, and horizontal pitch, i.e., the horizontal center-to-center spacing between adjacent apertures in the same horizontal row. FIG. 1 is a simplified plan view of one prior art approach showing a shadow mask 11 incorporating electron beam passing apertures 13 with a constant $P_v$ In the prior art shadow mask 11 of FIG. 1, the horizontal pitch $P_h$ is constant for all rows of apertures from the mask's Y-axis out to the lateral edges of the mask. The vertical pitch $P_v$ is also constant for all columns of apertures from the Y-axis out to the lateral edges of the mask.

Because of the curved geometry of the shadow mask and the display screen and because the electron beam is directed from a fixed point through the mask's apertures onto the phosphor elements on the display screen, the mask apertures and screen phosphor elements are not in alignment with respect to the electron beam over the entire surface of the display screen. In particular, misalignment between the beam passing apertures and the phosphor elements is most severe in the four corners of the display screen.

In the past, the primary emphasis in aperture spacing has been in terms of the horizontal pitch $P_v$ The reason for the emphasis on $P_v$ is because this parameter primarily determines the curvature of the mask, as well as its strength and stiffness. Until recently, shadow mask designers have not emphasized the vertical pitch $P_v$ of the mask apertures in shadow mask design.

More recent shadow mask designs employ a vari-bow design as shown in FIG. 2 which is a plan view of a shadow mask 15 incorporating a plurality of electron beam passing apertures 17 arranged in a vari-bow configuration. As in the prior art shadow mask discussed above, the horizontal pitch $P_h$ is constant over the entire surface of the shadow mask. The vari-bow design defines the vertical pitch $P_v$ in terms of the following expression:

$$P_v(x)=P_{vo}\times F(X) \quad (1)$$

where $P_{vo}$=vertical pitch at the Y-axis where X=0, and $$F(X)=1+aX^2, \quad (2)$$

with a=constant less than 0.

The vari-bow design facilitates CRT manufacture and assembly by increasing the color purity adjustment margin in the corners of the display screen. However, the vertical separation between adjacent trios of red, green and blue phosphor elements on the display screen's inner surface is reduced, resulting in a degradation in video image resolution in the corners of the screen. This is because $P_v$ decreases monotonically along the X-axis in accordance with Equation (1) and is minimum in the four corners of the display screen. This reduced video image resolution in the display screen corners of a color CRT employing a vari-bow shadow mask aperture arrangement is particularly severe in high resolution displays which are gaining increasingly greater commercial acceptance.

The present invention addresses the aforementioned limitations of the prior art by providing a shadow mask aperture arrangement for use in a color CRT which affords increased video image color purity adjustment margin without sacrificing video image resolution particularly in the corners of the CRT's display screen.

OBJECTS AND SUMMARY OF THE INVENTION

Accordingly, it is an object of the present invention to provide an aperture array in the shadow mask of a color CRT which affords increased video image color purity adjustment margin without sacrificing video image resolution.

It is another object of the present invention to provide an aperture array in a shadow mask which is particularly adapted for use in high resolution color CRTs in providing improved color purity adjustment margin and video image resolution particularly in the corners of the CRT's display screen.

This invention contemplates a shadow mask for use with a generally rectangular, curved display screen in a color cathode ray tube (CRT) having a plurality of electron beams arranged in an inline array, the display screen having electron beam sensitive phosphor elements on an inner surface thereof for providing a video image, the shadow mask comprising: a thin metal foil generally rectangular in shape and generally spherical in curvature, wherein the thin metal foil is disposed in closely spaced relation to the inner surface of the display and includes a horizontal X-axis and a vertical Y-axis each extending through a center of the metal foil and toward opposed lateral edges and opposed upper and lower edges thereof, respectively; and a plurality of spaced apertures in the metal foil arranged in vertical columns and horizontal rows, with apertures in one row being in different columns than are apertures in adjacent rows and with the vertical spacing between adjacent apertures within a column being the vertical pitch of the apertures, wherein each electron beam is directed through selected ones of the apertures and is incident upon selected ones of the phosphor elements on the display screen to provide one of the primary colors of red, green or blue of the video image, and wherein the vertical pitch of the apertures decreases monotonically in proceeding from the Y-axis to a lateral edge of the metal foil and increases monotonically in proceeding from the X-axis to an upper or lower edge of the metal foil.

This invention further contemplates a cathode ray tube (CRT) for displaying a color video image, the CRT comprising: an electron gun for providing a plurality of electron beams, wherein the electron beams are arranged in an inline array; a generally rectangular display screen having a generally spherical curvature and a plurality of discrete phosphor elements on an inner surface thereof, wherein each phosphor element emits red, green or blue light when an associated electron beam is incident thereon; and a generally rectangular shadow mask having opposed lateral edges and opposed upper and lower edges, the shadow mask disposed in closely spaced relation to the inner surface of the display screen and having a generally spherical curvature and a plurality of spaced apertures, wherein each electron beam is directed through selected ones of the apertures and is incident upon selected ones of the phosphor elements on the display screen for providing one of the primary colors of red, green or blue of the video image, wherein the apertures are arranged in vertical columns and horizontal rows, with apertures in one row being in different columns than are apertures in adjacent rows and with the vertical spacing between adjacent apertures within a column being the vertical pitch of the apertures, and wherein the vertical pitch of the apertures decreases monotonically in proceeding from the center to a lateral edge of the shadow mask and increases monotonically in proceeding from the center to an upper or lower edge of the shadow mask.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 3:
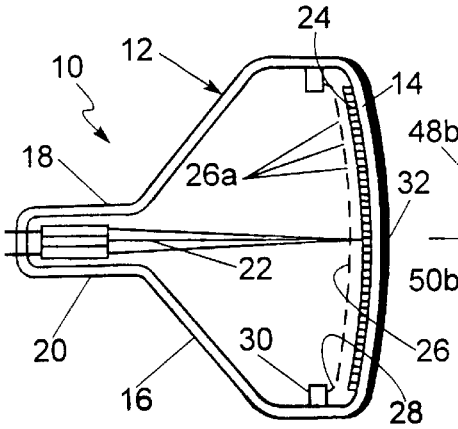
FIG. 3 is a lateral sectional view of a conventional color CRT in which the shadow mask of the present invention is intended for use.

Referring to FIG. 3, there is shown a lateral sectional view of a conventional color CRT 10 in which the shadow mask of the present invention is intended for use. The CRT 10 includes a sealed glass envelope 12 having a forward faceplate or display screen 14, an aft neck portion 18, and an intermediate funnel portion 16.

Disposed on the inner surface of glass faceplate 14 is a phosphor screen 24 which includes a plurality of discrete phosphor deposits, or elements, which emit light when an electron beam is incident thereon to produce a video image on the faceplate. The color CRT 10 includes three electron beams 22 directed onto and focussed upon the CRT's glass faceplate 14. Disposed in the neck portion 18 of the CRT's glass envelope 12 are a plurality of electron guns 20 typically arranged in an inline array for directing the electron beams 22 onto the phosphor screen 24. Electron beams 22 are deflected vertically and horizontally in unison across the phosphor screen 24 by a magnetic deflection yoke which is not shown in the figure for simplicity. Disposed in a spaced manner from phosphor screen 24 is a shadow mask 26 having a plurality of spaced electron beam passing apertures 26*a* and a skirt portion 28 around the periphery thereof. The shadow mask skirt portion 28 is securely attached to a shadow mask mounting fixture 30 around the periphery of the shadow mask. The shadow mask mounting fixture 30 is attached to an inner surface of the CRT's glass envelope 12 and may include conventional attachment and positioning structures such as a mask attachment frame and mounting springs which are described below.

The shadow mask mounting fixture 30 is attached to the inner surface of the CRT's glass envelope 12 by conventional means such as weldments or a glass-based frit and the shadow mask 26 is attached to the mounting fixture also by conventional means such as described below.

Figure 4:
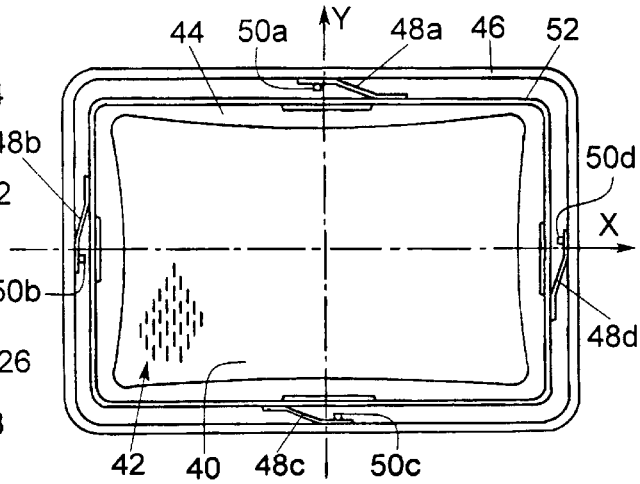
FIG. 4 is a plan view of a conventional shadow mask showing details of the manner in which the shadow mask is mounted within the CRT's glass envelope.

Referring to FIG. 4, there is shown a plan view of a conventional shadow mask 40 and details of the manner in which the shadow mask is mounted within the CRT's glass envelope 46. The shadow mask 40 is in the form of a thin metal foil and includes a plurality of spaced beam passing apertures 42 (only a portion of which are shown in the figure for simplicity). The beam passing apertures 42 are located in an inner portion of the shadow mask 40 which is maintained under tension and is in closely spaced relation from the CRT's glass faceplate. Disposed about the apertured inner portion of the shadow mask 40 is a shadow mask skirt 44. Attached to and disposed about the shadow mask skirt 44 is a shadow mask frame 52 having a generally rectangular shape. Disposed about the shadow mask frame 52 in a spaced manner are four resilient metal holders, or springs, 48*a*, 48*b*, 48*c* and 48*d*. The four resilient metal holders 48*a*, 48*b*, 48*c* and 48*d* are securely attached to the shadow mask frame 52 by conventional means such as weldments. Each resilient metal holder 48*a*, 48*b*, 48*c* and 48*d* includes an aperture for receiving a respective mounting stud 50*a*, 50*b*, 50*c* and 50*d*. Each of the mounting studs 50*a*, 50*b*, 50*c* and 50*d* is attached to a respective inner flat surface of the CRT's glass envelope 46 using conventional means such as a glass frit. The mounting studs 50*a*, 50*b*, 50*c* and 50*d* inserted through respective apertures in the resilient metal holders 48*a*, 48*b*, 48*c* and 48*d* securely maintain the shadow mask 40 in fixed position within the CRT's glass envelope 46 and in spaced relation from the CRT's glass faceplate, or display panel.

In accordance with the present invention, the limited purity adjustment margin of prior art shadow masks is improved by defining the vertical pitch between adjacent apertures aligned in a common vertical column in accordance with the following equation:

$$P_v(X,Y)=P_{vo}\times F(X)\times G(Y)$$

where $P_{vo}$=vertical pitch of apertures at Y=0 and X =0;

$F(X)=1+a_1X^2+a_2X^4+a_3X^6+\ldots$;

$G(Y)=1+b_1Y^2+b_2Y^4+b_3Y^6+\ldots;$ $a_1, a_2, a_3, \ldots$ are constants and $a_1<0$; and $b_1, b_2, b_3, \ldots$ are constants and $b_1>0$.

Providing the shadow mask with apertures having a vertical pitch in accordance with equation (3) increases the color purity adjustment margin particularly in the corners of the color CRT's display screen and thus improves color purity tolerance as described below.

Figure 1:
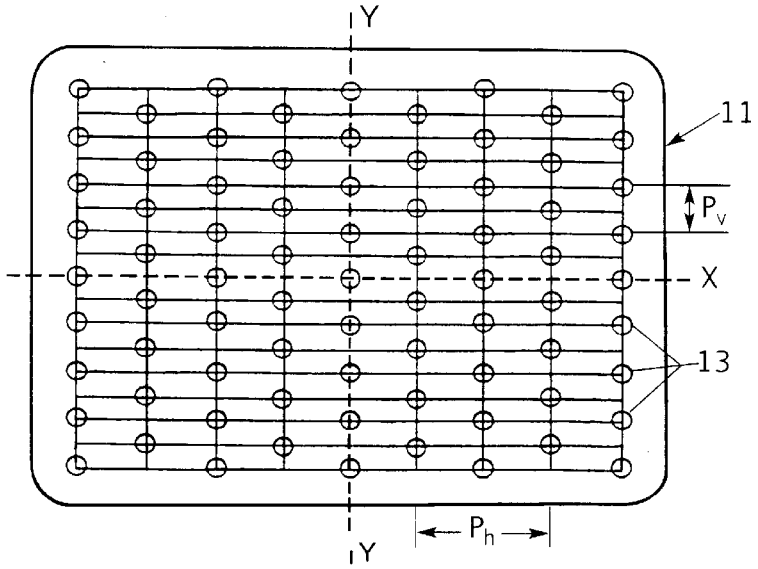
FIG.1 (PRIOR ART)
FIG. 1 is a simplified plan view of one prior art shadow mask approach wherein the mask apertures have a constant vertical pitch, $P_v$.
Figure 2:
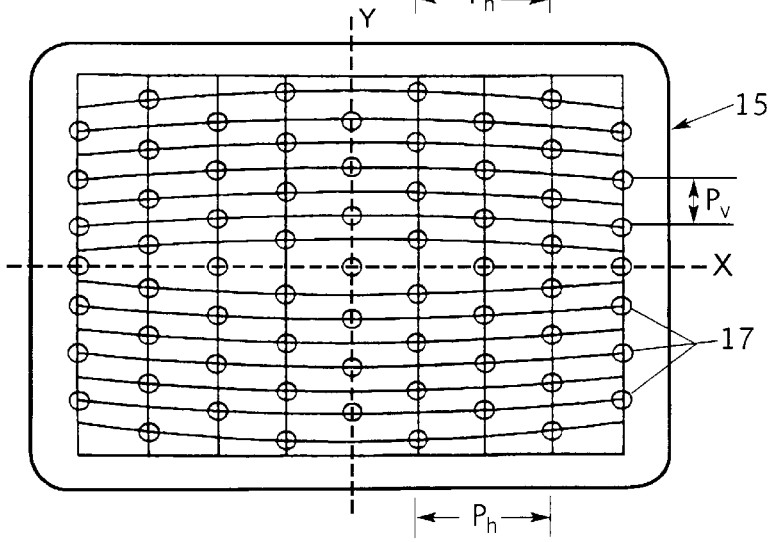
FIG.2 (PRIOR ART)
FIG. 2 is a simplified plan view of another prior art shadow mask approach wherein the shadow mask apertures are arranged in a vari-bow array, where the aperture vertical pitch decreases along the X-axis of the shadow mask in proceeding from the mask center to a lateral edge.
Figure 5:
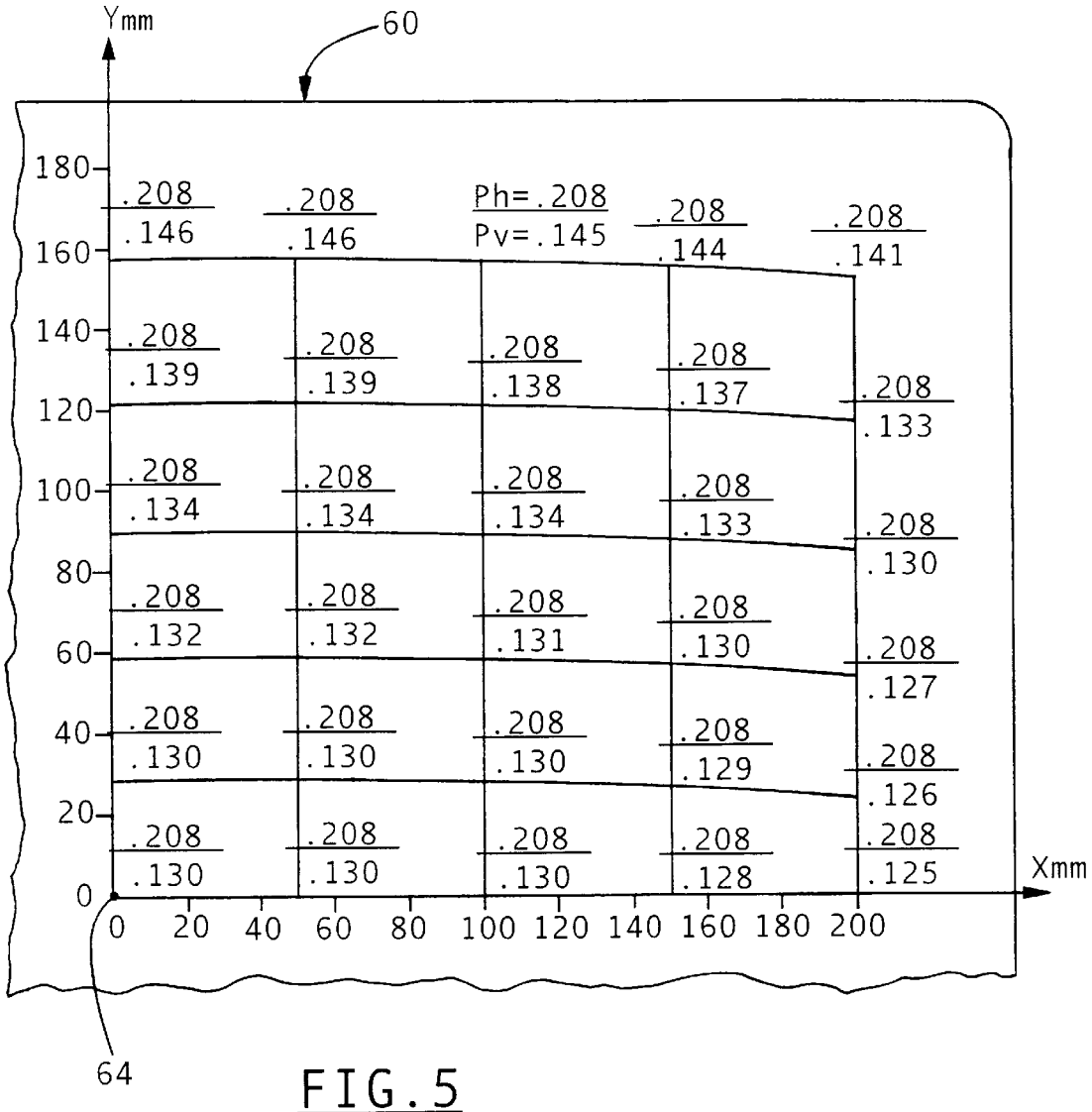
FIG. 5 is a simplified plan view of a color CRT shadow mask showing in general the vertical and horizontal pitch of the electron beam passing apertures in accordance with the present invention.

Referring to FIG. 5, there is shown a simplified elevation view of a portion of a shadow mask 60 having a plurality of electron beam passing apertures arranged in accordance with the present invention. FIG. 5 shows only the upper righthand quadrant of shadow mask 60 for simplicity sake, where the center of the shadow mask is located at point 64 in the figure. Shadow mask 60 includes a vertical Y-axis and a horizontal X-axis. The distances along each of the Y- and X-axes is measured in millimeters as shown in the figure. The distance scales along the Y- and X-axes illustrate the spacing of the beam passing apertures in shadow mask 60, where the apertures are arranged in a matrix array of vertical columns and horizontal rows. The intersection of the columns and rows of apertures is shown in the figure. The intersection of a column and row in the figure represents, in general, the pattern of apertures in shadow mask 60, but each intersection does not represent the location of an aperture because, for example, apertures in a given row are in different columns than are apertures in adjacent rows such as shown for the prior art shadow mask 15 shown in FIG. 2. Thus, the intersection of vertical columns and horizontal rows in FIG. 5 represents in a general manner the spacing of electron beam passing apertures in the shadow mask 60 of the present invention.

The upper number in each ratio associated with the intersection of each vertical column and horizontal row represents the horizontal pitch ($P_h$), while the lower number represents the vertical pitch ($P_b$) between adjacent apertures. As shown in the figure and in accordance with the present invention, the vertical pitch increases monotonically in proceeding from the X-axis toward either the upper or lower edge of the shadow mask. Also in accordance with the present invention, the vertical pitch is shown in the figure as decreasing monotonically in proceeding away from the Y-axis toward either the right of left lateral edge of the shadow mask 60. By monotonically increasing the vertical pitch of the shadow mask's beam passing apertures 62 in proceeding vertically away from the X-axis toward either the upper or lower edge of the mask, alignment between the apertures and phosphor elements on the inner surface of the CRT's display screen is improved to allow for increased color purity adjustment margin without sacrificing video image resolution particularly in the corners of the CRT's display screen.

There has thus been shown a shadow mask for use in a color CRT having a plurality of electron beam passing apertures arranged in vertical columns and horizontal rows, with the apertures spacing defined by a vertical pitch and a horizontal pitch. The vertical pitch is defined in terms of a monotonic decreasing function in the horizontal direction and a monotonic increasing function in the vertical direction to provide increased color purity adjustment margin particularly in the corners of the CRT's display screen while maintaining sufficient vertical spacing between adjacent phosphor dot color trios for a high degree of video image resolution.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A shadow mask for use with a generally rectangular, curved display screen in a color cathode ray tube (CRT) having a plurality of electron beams arranged in an inline array, said display screen having electron beam sensitive phosphor elements on an inner surface thereof for providing a video image, said shadow mask comprising:

a thin metal foil generally rectangular in shape and generally spherical in curvature, wherein said thin metal foil is disposed in closely spaced relation to the inner surface of the display screen and includes a horizontal X-axis and a vertical Y-axis each extending through a center of said metal foil and toward opposed lateral edges and opposed upper and lower edges thereof, respectively;

means defining a plurality of spaced apertures in said metal foil arranged in vertical columns and horizontal rows, with apertures in one row being in different columns than are apertures in adjacent rows and with the vertical spacing between adjacent apertures within a column being the vertical pitch ($P_v$) of the apertures, wherein each electron beam is directed through selected ones of said apertures and is incident upon selected ones of said phosphor elements on the display screen to provide one of the primary colors of red, green or blue of the video image, and wherein $P_v$ of said apertures decreases monotonically in proceeding from the Y-axis to a lateral edge of said metal foil and increases monotonically in proceeding from the X-axis to an upper or lower edge of said metal foil, wherein $P_v$ is given by the following expression:

$$P_v(X,Y)=P_{vo}\times F(X)\times G(Y)$$

where $P_{vo}$=vertical pitch of apertures at Y=0 and X=0;

$F(X)=1+a_1X^2+a_2X^4+a_3X^6+\ldots;$ $G(Y)=1+b_1Y^2+b_2Y^4+b_3Y^6+\ldots;$ $a_1, a_2, a_3, \ldots$ are real number constants less than zero in value; and $b_1, b_2, b_3, \ldots$ are real number constants greater than zero in value.

2. A cathode ray tube (CRT) for displaying a color video image, said CRT comprising:

electron gun means for providing a plurality of electron beams, wherein said electron beams are arranged in an inline array;

a generally rectangular display screen having a generally spherical curvature and a plurality of discrete phosphor elements on an inner surface thereof, wherein each phosphor deposit emits red, green or blue light when an associated electron beam is incident thereon; and a generally rectangular shadow mask having opposed lateral edges and opposed upper and lower edges, said shadow mask disposed in closely spaced relation to the inner surface of said display screen and having a generally spherical curvature and a plurality of spaced apertures, wherein each electron beam is directed through selected ones of said apertures and is incident upon selected ones of the phosphor elements on said display screen for providing one of the primary colors of red, green or blue of the video image, wherein said apertures are arranged in vertical columns and horizontal rows, with apertures in one row being in different columns than are apertures in adjacent rows and with the vertical spacing between adjacent apertures within a column being the vertical pitch ($P_v$) of the apertures, and wherein $P_v$ of said apertures decreases monotonically in proceeding from the center to a lateral edge of said shadow mask and increases monotonically in proceeding from the center to an upper or lower edge of said shadow mask, wherein $P_v$, is given by the following expression:

$$P_v(X,Y)=P_{vo}\times F(X)\times G(Y)$$

where $P_{vo}$=vertical pitch of apertures at Y=0 and X=0;

$F(X)=1+a_1X^2+a_2X^4+a_3X^6+\ldots$;

$G(Y)=1+b_1Y^2+b_2Y^4+b_3Y^6+\ldots$;

$a_1, a_2, a_3, \ldots$ are real number constants less than zero in value; and $b_1, b_2, b_3, \ldots$ are real number constants greater than zero in value.

* * * * *

UNITED STATES PATENT AND TRADEMARK OFFICE

CERTIFICATE OF CORRECTION

PATENT NO. : 6,157,119
DATED : December 5, 2000
INVENTOR(S) : Hao-Cheng Hung et al.

It is certified that error appears in the above-identified patent and that said Letters Patent is hereby corrected as shown below:

Column 1,
Line 8, delete "a n" and insert -- an --
Line 15, after "three" insert -- independent --
Line 54, delete "$P_v$" and insert -- $P_h$ --
Line 55, delete "$P_v$" and insert -- $P_h$ --

Column 5,
Line 56, delete "apertures" and insert -- apertures' --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*